United States Patent [19]

Long

[11] 4,448,639

[45] May 15, 1984

[54] MINERAL FIBER-CONTAINING PAPER FOR THE PRODUCTION OF GYPSUM WALLBOARD PRODUCT PREPARED THEREWITH

[75] Inventor: William J. Long, Chicago, Ill.

[73] Assignee: United States Gypsum Company, Chicago, Ill.

[21] Appl. No.: 391,627

[22] Filed: Jun. 24, 1982

[51] Int. Cl.[3] ..... D21H 1/02

[52] U.S. Cl. ..... 162/124; 162/145; 162/152; 162/168.3; 162/169; 162/187; 428/703

[58] Field of Search ..... 162/145, 152, 124, 168.3, 162/169, 187; 156/39; 428/703

[56] References Cited

U.S. PATENT DOCUMENTS

| | | | |
|---|---|---|---|
| 3,562,097 | 2/1971 | von Hazmburg | 162/145 |
| 3,952,130 | 4/1976 | Nasan | 162/145 |
| 4,020,237 | 4/1977 | von Hazmburg | 428/103 |
| 4,372,814 | 2/1983 | Johnstone et al. | 162/124 |

*Primary Examiner*—William F. Smith

*Attorney, Agent, or Firm*—Samuel Kurlandsky; Robert M. Didrick; Robert H. Robinson

[57] ABSTRACT

A paper cover sheet material for use in the production of gypsum wallboard, the paper cover sheet material having excellent drainage, porosity and drying properties, and a wallboard product produced therefrom, the paper cover sheet material being produced from fibers comprising a major proportion of cellulose fibers and a minor proportion of mineral fibers, the paper composition additionally comprising a cellulose gel, a latex binder and a flocculating agent, thereby enabling the mineral fibers to be dispersed in an aqueous slurry without materially fracturing the fibers, and retaining the shot present in the mineral fibers without permitting the shot to be released and thereby to contaminate the papermaking equipment. The excellent porosity, drying properties and drainage of the paper permit the gypsum wallboard formed with the paper to be readily set and dried with reduced heat energy requirements.

12 Claims, No Drawings

MINERAL FIBER-CONTAINING PAPER FOR THE PRODUCTION OF GYPSUM WALLBOARD PRODUCT PREPARED THEREWITH

BACKGROUND OF THE INVENTION

1. Field of the Invention

The present invention relates to the manufacture of paper cover sheet material for use in producing gypsum wallboard, and to the gypsum wallboard produced from the paper cover sheet material, and more particularly refers to such paper cover sheets in which there is incorporated mineral fiber.

2. Description of the Prior Art

As is known, paper covered gypsum board comprising a cast gypsum core and paper cover sheets is widely used in building construction. The product may be in the form of wallboard, lath and the like. In manufacturing such gypsum board the face paper is usually drawn over a forming table, a water-stucco slurry spread over the paper sheet and the back paper cover sheet applied thereover before the slurry has set. The board is then cut to desired size and dried in a kiln. In use the board is cut to size by scoring and snapping or by sawing, and is applied to a wall by means of clips, nails, screws or adhesives.

The strength and other properties of the finished gypsum board depend to a considerable extent on the paper cover sheets employed, which paper cover sheets must be of such nature as to have properties which enable the board to be manufactured to close dimensional specifications, be of high strength, have suitable surface quality, be readily dried, and able to form a good bond with the gypsum core.

It has been previously recognized that the incorporation of a minor proportion of mineral fibers into the cellulose furnish can result in the realization of improvement in the properties of the paper cover sheets. The use of mineral fiber is disclosed in U.S. Pat. No. 3,562,097 and U.S. Pat. No. 4,020,237. As disclosed in these patents, the paper cover sheet material is made by separately dispersing a mass of cellulose fibers and mineral fibers in water, combining the two dispersions of the fibers in desired proportion, and finally forming the combined fibers into a web of paper on a papermaking cylinder machine.

To reiterate, the advantages of blending mineral wool fibers with paper fibers are:

(1) improved stock drainage,
(2) lower sheet porosity value, and
(3) faster paper and board drying.

Unfortunately, these advantages and the use of mineral fiber-containing paper have not been taken advantage of in the past because of three major problems. First and foremost, the use of mineral fibers results in an excessive amount of unretained shot contaminating the paper mill system. This results from the fact that conventional mineral fiber material as it is commonly produced has a large amount of shot, that is, spherical particles of molten and then hardened slag. Consequently, when the mineral fibers are dispersed in water, a great deal of energy is used in the dispersing process, during which a large amount of the shot is released and falls to the bottom of the apparatus and results in the contamination of the apparatus used in the papermaking process.

Second, a reduction in physical strength values has occurred in nearly a direct ratio to the amount of mineral fibers added. Finally, there has been poor dispersibility of the mineral fibers in the paper slurries, resulting in excessive shattering and shortening of the mineral fibers on mixing.

SUMMARY OF THE INVENTION

It is accordingly an object of the present invention to provide a unified slurry composition for making paper which eliminates the problem of shot contamination in the paper making system, without the necessity for utilizing sophisticated and expensive techniques and equipment to remove the shot.

It is a further object to provide a material and method which provide a faster draining web, a more porous sheet, and a faster drying sheet, without a corresponding loss of physical strength of the sheet.

It is an additional object to provide a method of making paper cover sheets which effectively disperses the mineral fibers in the slurry mixture without materially reducing the length and structure of the mineral fibers.

Other objects and advantages of the invention will be apparent from a study of the following description.

According to the invention an aqueous slurry is provided comprising a latex binder, a flocculating agent, and a cellulose gel such as kraft/news gel. The slurry includes a major proportion of cellulose fiber pulp, and a minor proportion of mineral wool fibers. The mineral wool fibers are readily dispersed in the slurry without destruction of the fibers and without having the shot escape from the fibers. After completing the papermaking process and drying the paper, the resulting paper has excellent properties for use as paper cover sheets in the manufacture of gypsum wallboard.

DESCRIPTION OF THE PREFERRED EMBODIMENTS

Various ideas have been proposed and many attempts have been made in the past to incorporate mineral wool fibers in gypsum board papers. The purpose of incorporating mineral wool fibers has been to provide faster pulp drainage during the paper making process, higher sheet porosity, improved sheet stability, and improved paper and board drying. These attempts were unsuccessful due to the following circumstances:

1. The material shortening of the mineral fiber length required to achieve a wall dispersed slurry, and
2. The existence of shot in the mineral wool fiber that settled out in the paper mill tanks and vats and, even when retained in the paper, deposited on the wires.
3. Sheet tensile strength loss in papers containing mineral fibers.

In accordance with the present invention, from about 1 to about 10 percent of a hydrated gel formed from kraft paper or similar papers is utilized as a means of dispersing the mineral wool in the slurry. The gel cushions the mineral fibers from the acute dispersion action and thus preserves the original length of the mineral fibers. A sheet containing mineral fibers of good fiber length also has improved sheet bulk, which prevents the formation of sheet pinholes which are quite prevalent in shot-loaded mineral fiber papers prepared by prior art methods. Improved sheet formation is also obtained.

The present invention additionally includes flocculating the suspended shot in the stock system using special latexes and flocculants. The flocculant process, coupled with the mineral fibers of longer fiber lengths, results in maximum shot suspension in the slurry, uniform shot distribution in the sheet, and avoidance of shot contamination in the paper making system.

The following examples are provided for informational purposes and are not intended in any way to be limiting in regard to the claiming of the invention.

EXAMPLES 1–5

Handsheets were prepared according to TAPPI method T-205. According to the method, 2000 milliliters of water were mixed with 24OD (oven dried) grams of cellulose paper fibers. This mixture was disintegrated in a TAPPI disintegrator for 25 minutes. After disintegration of the paper fibers, refined waste-news gel prepared at 6% consistency was added to the paper fiber slurry diluted to 0.3% slurry consistency. This blend was mixed together for 5 minutes using the laboratory Lightnin' mixer at 1000 rpm. The mineral fiber in dry form was then added to the paper fiber-gel blend and mixed for 5 minutes with the Lightnin' mixer at 1000 rpm. Following dispersion of the mineral fibers in the slurry, the latex was next added to the paper fiber-gel-mineral fiber mix and agitated for an additional 2 minutes. Finally the flocculant was added to the mixture and again agitated for 2 minutes. From this slurry mix, handsheets were formed in a TAPPI sheet mold, drainage tested by TAPPI T-221 procedures, and the paper then dried following the TAPPI T-205 procedures.

Table I, below, lists the compositions utilized in Examples 1–5 and the properties of the test sheets which were determined. The handsheets were prepared according to the method described above and according to standard TAPPI-205 procedures. The paper fiber used comprised a waste blend of 70% waste corrugated and 30% waste news refined to a pulp freeness of 350 ml Canadian Standard Freeness. The mineral wool fiber utilized was produced from blast furnace slag at the Walworth plant of United States Gypsum Company and is referred to as "white wool" with 28% shot. A typical example of mineral wool composition consists by weight of about 36% silica, 36% calcium oxide, 15% aluminum oxide, and 13% magnesium oxide. The gel dispersant was prepared from a cellulosic fiber furnish of 70% unbleached kraft pulp and 30% waste newspapers. Furnish blend was gelatinized by passing through a series of refiners to attain a requisite drainage time of 5 minutes minimum in accordance with TAPPI T-221 and a requisite shrinkage of 25% minimum as tested following TAPPI UM238. This fiber hydration is far beyond that commonly used in the paper industry and its preparation is more fully described in U.S. Pat. No. 3,379,608.

TABLE I

| Test Description [TAPPI 200] | Examples 1: 100% Paper Fibers | 2: 75% Paper Fibers, 25% Mineral Fibers | 3: 72.5% Paper Fibers, 25% Mineral Fibers, 2.5% K/N Gel | 4: 70% Paper Fibers, 25% Mineral Fibers, 5% K/N Gel | 5: 67.5% Paper Fibers, 25% Mineral Fibers 7.5% K/N Gel |
|---|---|---|---|---|---|
| Basis wt. - g/m$^2$ | 74.8 | 75.4 | 74.2 | 75.6 | 74.4 |
| Drainage Time-Seconds | 7.5 | 5.2 | 5.8 | 6.1 | 8.8 |
| Porosity-Sec/100 cc Air | 10.8 | 2.0 | 2.8 | 4.8 | 8.9 |
| Breaking Length-meters | 2229 | 1606 | 1773 | 2012 | 2235 |
| Burst Factor | 11.4 | 4.6 | 5.5 | 7.2 | 13.4 |

The results obtained and shown in Table I above indicate that a kraft gel addition of about 5% is optimum for promoting an appreciable tensile strength while still maintaining sufficient advantages with regard to pulp drainage and sheet porosity. While it can be seen that some of the drainage and porosity properties are lost on 5% gel additions, as opposed to lower amounts, the substantial improvement in sheet tensile strength clearly compensates for these loses. As an amount above 5% is utilized, however, it can be considered as an overkill of the drainage and porosity property benefits while contributing to a deterioration of desirable properties.

EXAMPLES 6–11

In Examples 6–11 additional sheets were made involving a composition substantially of 70% paper fibers, 25% mineral fibers, and 5% gel, utilizing various amounts of latex and flocculant additives. The latex used was a Dow product designated as Latex Dow XD-30374-a copolymer of styrene and butadiene. The flocculant used was a Dow product identified as Polymeric PC-XD 30440. Both products are more fully described in Dow Chemical Company U.S. Pat. No. 4,225,383, granted Sept. 30, 1978. The purpose of utilizing the latex and flocculant was to obtain an agglomerate of paper, gel and mineral fibers whereby the mineral fiber shot particles are effectively suspended in a stock slurry. The advantages of substantial shot suspension was two-fold, (1) elimination of shot from the paper making system, and (2) maximum shot retention in the subject mineral fiber/paper fiber sheet.

In Table II, below, are presented data with regard to the various compositions of the handsheets prepared in Examples 6–11 together with the properties of the products measured.

TABLE II

| Test Description [TAPPI 220] | Examples 6: 70% Paper Fiber, 25% Min. Fiber, 5% Gel | 7: 69% Paper Fiber, 25% Min. Fiber, 5% Gel 1% Latex, 0.05% Flocculant | 8: 67.5% Paper Fiber, 25% Min. Fiber, 5% Gel 2.5% Latex, 0.1% Flocculant | 9: 65% Paper Fiber, 25% Min. Fiber, 5% Gel 5% Latex 0.2% Flocculant | 10: 62.5% Paper Fiber, 25% Min. Fiber, 5% Gel 7.5% Latex, 0.3% Flocculant | 11: 100% Paper Fiber |
|---|---|---|---|---|---|---|
| Basis wt. - g/m$^2$ | 75.6 | 75.2 | 74.5 | 76.93 | 75.15 | 74.7 |
| Drainage Time - Seconds | 6.1 | 6.0 | 5.8 | 6.0 | 5.8 | 7.5 |
| Porosity - Sec/100 cc Air | 4.8 | 4.8 | 4.6 | 4.5 | 4.3 | 10.8 |
| Breaking Length - Meters | 2012 | 1975 | 2103 | 2278 | 2340 | 2229 |
| Burst Factor | 7.2 | 7.5 | 8.84 | 9.86 | 11.17 | 11.4 |

The results obtained and presented in Table II above show that the resulting sheets exhibited improved advantages of tensile strength, drainage, and porosity, the properties being obtained through latex additions. In fact, the handsheets made in Example 9 having 5% latex were comparable in tensile strength with handsheets made of 100% paper fiber. However, the formulation utilizing 2.5% latex and 0.1% flocculant appeared to be adequate for suspending the shot in the slurry formulation to be used for commercial products. This conclusion was based on visual observations of glass beakers containing the different slurry agglomerates. The materials of Examples 6 and 7 in slurry form at 0.15% consistencies showed evidence of shot settling out in the bottom of the glass beakers. In sharp contrast, the slurries of Examples 8, 9 and 10, at comparable 0.15% slurry consistencies showed excellent shot distribution throughout the slurry mix with no evidence of shot deposits on the bottom of the glass beakers.

As stated above, one of the problems encountered in prior art efforts to produce a mineral fiber-containing paper was the presence of shot. The present invention attempts to overcome this problem by utilizing a combination of a latex and one or more flocculating agents to retain the shot so that it will not contaminate the papermaking equipment. Among the latexes utilized and which gives excellent results is a copolymer of styrene-butadiene. This and other materials are described in Dow Chemical Company U.S. Pat. No. 4,225,383. Other polymers may also be utilized such as polyvinyl alcohol, which are commonly known in the art as binders. The flocculating agent may be chosen from among the starches, polymers such as Dow Chemical Polymeric PC-XD (a preferred material), alum, and others such as polyacrylamides. The purpose of the latex-flocculant combination is to provide a paper/mineral fiber agglomerate in an aqueous solution for retaining mineral fiber shot in the sheet in a uniform and discrete fashion. By effecting a stock slurry system for retaining the shot in the paper, contamination of the paper mill chest, vats, and machine wires are thus avoided. This also eliminates the need for shot removal techniques. The latex also lends additional strength to the paper/-mineral fiber product.

The second problem which the present invention seeks to overcome is that of sheet strength loss which may be caused by the presence of the mineral fibers. This problem is eliminated by the use of restricted amounts of mineral wool fibers with selected amounts of kraft/news gel and latex. These materials result in the preparation of paper sheets having maximum strengths, while still retaining the optimum advantages of rapid drainage, porosity, and rapid drying.

The use of the kraft/news gel also results in a better dispersibility of the mineral fibers. The material also results in the cushioning of the fragile mineral fibers from the turbulence of the mixing action. In utilizing the gel, its adverse effect on slowing draining and making a less porous sheet is avoided by careful selection of proportions of mineral wool and gel to maintain the optimum characteristics of the materials. An optimum composition of the material components is as follows in terms of percent of total composition by dry weight. The percentages of the K/N gel, the latex and the flocculant have been corrected for original water content.

| | |
|---|---|
| Paper Fibers | 64.8% |
| Mineral Wool Fibers | 25% |
| K/N (kraft/news) Gel | 5% |
| Latex | 5% |
| Flocculant | 0.2% |

Although the above stated proportion has been found to be optimum, suitable papers for use in making gypsum board can be obtained from the following range of proportions:

| | Percentage by Weight |
|---|---|
| Paper Fibers | 65–95% |
| Mineral Fibers | 5–40% |
| K/N (kraft/news) Gel | 1–10% |
| Latex | 1–10% |
| Flocculant | .05–.5% |

The following examples were carried out to study the effects of the utilization of mineral fiber with regard to the rate of sheet drying.

EXAMPLE 12

An aqueous slurry having a 1.2% fiber consistency was prepared comprising 25% mineral wool fibers, 64.8 percent paper fibers (70% waste corrugated and 30% waste newspapers), and 5% kraft/news gel. After obtaining adequate fiber dispersion on mixing, 5% latex (Dow's XD-30374) was added and the slurry mixed an additional 5 minutes. Finally, a fibrous agglomerate was formed by floccing the latex with Dow's Polymeric PC-XD 30440 (0.2 percent). Handsheets were then prepared in the TAPPI handsheet mold at 0.15% pulp consistency. After normal TAPPI couching, the sheets were weighed for moisture determinations. Following these weighings, the sheets were then run a number of passes through a Noble and Wood sheet dryer at 240° F. drum dryer temperature, testing for subsequent sheet moistures following each pass through the dryer.

EXAMPLE 13

As a control, sheets comprising 100% paper fibers (70% corrugated and 30% news) were slurried, formed, couched, weighed, dried, and reweighed in the same manner as that described above in Examples 1–5.

The results of tests on the sheets produced from Examples 12 and 13 are shown below in Table III. The results were based on an average of 5 test sheets of approximately 1.5 grams (or 70 gms/m$^2$) each.

TABLE III

| | On Couch Pressing | | First Dryer Pass | | Second Dryer Pass | | Third Dryer Pass | |
|---|---|---|---|---|---|---|---|---|
| Sheet Description | wt-gm | % Fiber | wt-gm | % Fiber | wt-gm | % Fiber | wt-gm | % Fiber |
| Example 12* | 4.66 | 32.4 | 2.30 | 65.6 | 1.51 | 100 | 1.51 | 100 |
| Example 13** | 5.77 | 26.5 | 3.19 | 47.9 | 1.62 | 94.4 | 1.53 | 100 |

Note:
*Cellulose fiber/mineral fiber sheet of invention
**100% cellulose fiber sheet control The results above obtained from testing the materials of Examples 12 and 13 illustrate the improved water removal rates on couch pressing and the improved drying rates obtained by utilizing the sheet composition of the invention prepared by Example 12. What the results show is that a 22% improvement in water removal on pressing and a 36% improvement on a first dryer pass were achieved. This clearly results in a substantial energy savings.

EXAMPLES 14 AND 15

In Examples 14 and 15 tests were made to compare the lengths of the resulting mineral fibers in paper prepared by the present invention utilizing cellulose gel in comparison with the length of mineral fibers of paper prepared by the method of U.S. Pat. No. 3,562,097.

The handsheets of Example 15 according to the invention were prepared according to the method of Examples 1–5 above comprising 25% mineral fibers, 65% paper fibers, 5% cellulose gel, and 5% latex/floc. In Example 14 the formulation comprised 25% mineral fibers and 65% paper fibers, but the method utilized in preparing the handsheets was that of U.S. Pat. No. 3,562,097. After the handsheets were formed and dried, the mineral fibers utilized for fiber length determinations were obtained by wetting and gently separating the fibers of an unsized formed handsheet. The mineral fibers obtained from the handsheet formed according to the invention as described in Example 15 measured between 16/64 inch long and 32/64 inch long. In comparison, in Example 14 the fibers recovered from the handsheet formed according to U.S. Pat. No. 3,562,097 were only 2/64 inch to 4/64 inch long. The increased fiber length of the mineral fibers is important in achieving both maximum mineral fiber and shot retention, and improved sheet formation.

Gypsum Board Production

EXAMPLE 16

Multi-ply handsheets utilizing the sheet formulation of Example 4 and weighing 4.8 grams were prepared according to TAPPI method T-205 as utilized in Examples 1–5 above. The multi-ply sheets consisted of four single plies measuring 200 square centimeters each. The 4.8 gram multi-ply sheets were equivalent to a standard commercially produced sheet weight of 52 pounds per 1000 square feet. An aqueous slurry was prepared of commercial calcium sulfate hemihydrate. The core formulation per 1000 square feet of board included 1450 pounds stucco, 6 pounds of core starch, 4 pounds of calcium sulfate dihydrate accelerator and 2 pounds of $K_2SO_4$. The Vicats determined were about 8 minutes. The boards formed by depositing the slurry between two handsheets were dried to 70% of their wet weight at 340° F., followed by drying conditions of 16 hours at 110° F. Board densities measured 46–48 pounds per cubic foot.

Without any exception, all of the boards formed showed excellent wet, dry and humidified bond between the paper sheets and the gypsum core.

EXAMPLE 17

For purposes of comparison, laboratory boards were made with standard gypsum board papers produced in a commercial plant and utilizing the same gypsum core formulation. The bond results were comparable to that of the mineral fiber-containing boards produced in Example 16 above, showing excellent wet, dry and humidified bond.

The major difference noted between the two types of boards was a somewhat rougher texture associated with the mineral fiber board product. However, this can be compensated for by utilizing one overlay ply of fibers on cylinder made gypsum board papers. Because of the use of the mineral fiber in the board of Example 16, less energy was consumed in drying the paper during its formation. Less energy is utilized in setting and drying the finished board products because of the greater porosity of the paper.

The method and product of the present invention have a number of advantages over those of the prior art. When the mineral and paper fibers are mixed together with the kraft or cellulose gel, the mineral fiber structure remains intact and the sheet strength increases. In prior art processes, when the shot is removed, the fibers are materially shortened, with a sacrifice of pulp drainage and with a concomitant reduction in strength of the paper. Moreover, in prior art processes, when the shot is not removed the shot separates from the slurry and contaminates the paper making apparatus.

Further when the mineral fibers, cellulose fibers, and gel constituents are flocculated and/or agglomerated with a latex and flocculant, as in the present invention, the pulp drainage, sheet porosity, and sheet strength are all further improved. The latex and flocculant addition further tends to promote more effective mineral fiber shot suspension in the slurry and better shot retention in the sheet. Moreover, the use of mineral fibers, gel, and latex/flocculant addition provides improved drying results, leading to a savings in energy.

In summary, the present invention results in effective shot suspension and retention in the sheet with a cellulose gel and latex/flocculant addition, without the necessity of removing the shot, or without the disadvantage suffered in shot contamination. Further advantages are found in faster pulp drainage, improved sheet porosity, increased sheet stability, and superior pressing and drying characteristics.

It is to be understood that the invention is not to be limited to the exact details of formulation, operation, materials or compositions shown and described, as obvious modifications and equivalents will be apparent to one skilled in the art.

Invention is claimed as follows:

1. A method for the preparation of porous mineral fiber-containing paper cover sheet material suitable for use in preparing gypsum wallboard, which comprises forming an aqueous slurry comprising cellulose fibers, mineral fibers containing substantially all the shot resulting from their formation, cellulose gel, a polymeric latex binder and a flocculant without said shot being released from the mineral fibers, applying said slurry to a paper-making machine and forming paper therefrom, and drying the paper; said cellulose fibers being present on a dry weight basis in an amount from about 65% to about 95%, said shot-containing mineral fibers being present in an amount of from about 5% to about 40%, said cellulose gel being present in an amount of from about 1% to about 10%, said polymeric latex binder being present in an amount of from about 1% to about 10%, and said flocculant being present in an amount of from 0.05% to about 0.5%.

2. A method according to claim 1, wherein said polymeric latex binder is a copolymer of styrene and butadiene, and said flocculant is a polyacrylamide.

3. A method according to claim 1, wherein on a dry weight basis of total paper cover sheet composition said cellulose fibers are present in an amount of about 65%, said mineral fibers are present in an amount of about 25%, said cellulose gel is present in an amount of about 5%, said latex is present in an amount of about 5%, and said flocculant is present in an smount of about 0.2%.

4. Porous mineral fiber-containing paper cover sheet material suitable for use in preparing gypsum wallboard, which comprises cellulose fibers, mineral fibers containing substantially all the shot resulting from their formation, cellulose gel, a polymeric latex binder and a flocculant, on a dry weight basis, said cellulose fibers being present in an amount from about 65% to about 95%, said shot-containing mineral fibers being present in an amount of from about 5% to about 40%, said cellulose gel being present in an amount of from about 1% to about 10%, said polymeric latex binder being present in an amount of from about 1% to about 10%, and said flocculant being present in an amount of from 0.05% to about 0.5%.

5. A paper cover sheet material according to claim 4, wherein said polymeric latex binder is a copolymer of styrene and butadiene, and said flocculant is a polyacrylamide.

6. A paper cover sheet material according to claim 4, wherein on a dry weight basis said cellulose fibers are present in an amount of about 65%, said mineral fibers are present in an amount of about 25%, said cellulose gel is present in an amount of about 5%, said latex is present in an amount of about 5%, and said flocculant is present in an amount of about 0.2%.

7. A method for the preparation of gypsum wallboard having porous mineral fiber-containing paper cover sheets, which comprises preparing the paper cover sheet material by forming an aqueous slurry comprising cellulose fibers, mineral fibers containing substantially all the shot resulting from their formation, cellulose gel, a polymeric binder and a flocculant without said shot being released from the mineral fibers applying said slurry to a paper-making machine and forming paper therefrom, drying the paper, depositing an aqueous slurry comprising calcium sulfate hemihydrate between two sheets of the paper formed, permitting the slurry to set, and drying the gypsum wallboard formed, on a dry weight basis, said cellulose fibers being present in an amount from about 65% to about 95%, said shot-containing mineral fibers being present in an amount of from about 5% to about 40%, said cellulose gel being present in an amount of from about 1% to about 10%, said polymeric latex binder being present in an amount of from about 1% to about 10%, and said flocculant being present in an amount of from 0.05% to about 0.5%.

8. A method according to claim 7, wherein said polymeric latex binder is a copolymer of styrene and butadiene, and said flocculant is a polyacrylamide.

9. A method according to claim 7, wherein said paper cover sheet material on a dry weight basis comprises said cellulose fibers in an amount of about 65%, said mineral fibers in an amount of about 25%, said cellulose gel in an amount of about 5%, said latex in an amount of about 5%, and said flocculant in an amount of about 0.2%.

10. Gypsum wallboard comprising a core of set calcium sulfate dihydrate having a mineral fiber-containing paper cover sheet on each major surface thereof, said paper cover sheet formed of a paper composition comprising cellulose fibers, mineral fibers containing substantially all the shot resulting from their formation, cellulose gel, a polymeric latex binder and a flocculant, on a dry weight basis, said cellulose fibers being present in an amount from about 65% to about 95%, said shot-containing mineral fibers being present in an amount of from about 5% to about 40%, said cellulose gel being present in an amount of from about 1% to about 10%, said polymeric latex binder being present in an amount of from about 1% to about 10%, and said flocculant being present in an amount of from 0.05% to about 0.5%.

11. Gypsum wallboard according to claim 10, wherein said polymeric latex binder is a copolymer of styrene and butadiene and said flocculant is a polyacrylamide.

12. Gypsum wallboard according to claim 10, wherein said paper cover sheet composition on a dry weight basis comprises said cellulose fibers in an amount of about 25%, said cellulose gel in an amount of about 5%, said latex in an amount of about 5%, and said flocculant in an amount of about 0.2%.

* * * * *